US006450231B1

(12) United States Patent
Ishikawa

(10) Patent No.: US 6,450,231 B1
(45) Date of Patent: Sep. 17, 2002

(54) COATING FILM TRANSFER APPARATUS

(75) Inventor: Takahiro Ishikawa, Tokyo (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 09/255,751

(22) Filed: Feb. 23, 1999

(30) Foreign Application Priority Data

Sep. 18, 1998 (JP) ..... 10-264691

(51) Int. Cl.[7] ..... B05C 21/00; B32B 35/00

(52) U.S. Cl. ..... 156/577; 156/574; 156/579; 118/200; 118/257

(58) Field of Search ..... 156/540, 574, 156/577, 579, 521, 523; 118/257, 200, 76; 244/588.2, 588.3, 588.6, 588

(56) References Cited

U.S. PATENT DOCUMENTS 3,308,002 A 3/1967 Hurwich et al.
4,671,687 A 6/1987 Tamai
4,853,074 A 8/1989 Manusch et al.
5,595,626 A * 1/1997 Yokouchi et al. ..... 156/577
5,772,840 A * 6/1998 Morinaga ..... 156/540
5,792,263 A * 8/1998 Koyama et al. ..... 118/257
5,942,036 A * 8/1999 You ..... 118/257
6,270,578 B1 * 8/2001 Murakoshi ..... 118/257

FOREIGN PATENT DOCUMENTS

EP 0 427 870 A 5/1991
EP 0 742 111 A 11/1996

OTHER PUBLICATIONS

Patent Abstract of Japan, vol. 1998, No. 13, Nov. 30, 1998 & JP 10 217688 A (General CO LTD), Aug. 18, 1998.

* cited by examiner

*Primary Examiner*—Richard Crispino
*Assistant Examiner*—Sue A. Purvis
(74) *Attorney, Agent, or Firm*—Birch, Stewart, Kolasch & Birch, LLP

(57) ABSTRACT

A coating film transfer apparatus capable of affixing a transfer coating film on a surface of a base tape to a desired location of a paper or the like accurately and easily with a strong adhesive performance and cutting off an excessive portion of a transferred coating film accurately and beautifully. A bottom end face 9*b* of a pressing lever 9 for guiding a coating film provided tape or a corrective tape 12 provided in a case 1 and pressing it onto a paper surface 13 is formed in a flat surface having a width in the back and forth direction and a front edge thereof is formed in a sharp linear angle edge.

11 Claims, 5 Drawing Sheets

COATING FILM TRANSFER APPARATUS

BACKGROUND OF THE INVENTION

1. Field of the Invention

This invention relates to a coating film transfer apparatus capable of applying a transfer coating film such as corrective coating agent, fluorescent paint or adhesive agent, affixed to a surface of a coating film tape via a releasing agent layer by pressing the same tape onto a paper surface from a rear side thereof to transfer the same coating film to a desired position of the paper surface, and then separating an excessive portion of the transfer coating film from an already applied coating film.

2. Description of the Prior Art

In a coating film transfer apparatus according to a known conventional art, a transfer coating film is composed of a corrective coating film and a corrective tape is formed by attaching this transfer coating film to a surface of a base tape via a releasing layer. A reel around which this corrective tape is wound is provided in a case, and the corrective tape is fed along a front end of a pressing lever projecting through a cutout hole provided in the case in a condition that the corrective coating film side faces outward, then reversed at the front end and wound up by another reel in the case. In this process, by pressing the front end of the aforementioned pressing lever onto a position having a written letter desired to erased, the corrective coating film on the surface of the corrective tape is affixed to the desired position and after that, an excessive portion of the corrective coating film is separated by cutting off.

Typical arts of the conventional ones are described in following reference documents.

(1) Examined Published Japanese Patent Application No.HEI3-11639

(2) Examined Published Japanese Patent Application No.HEI3-66159

(3) Examined Published Japanese Patent Application No.HEI6-33125

Further, such an art in which a place to be erased is worn by making an adhesive tape into a sliding contact with that place and removed dust is made to stick to the adhesive tape, has been described in a following reference document.

(4) Unexamined Published Japanese Patent Application No.SHO50-152834

On the other hand, hand-grip type adhesive tape feeding apparatuses considered to be related to the present invention more or less have been described in following reference documents.

(5) U.S. Pat. No. 3,274,0381

(6) U.S. Pat. No. 3,505,153

(7) EP No.0551522A1

The inventions described in the above-mentioned reference documents have following problems.

(1) Examined Published Japanese Patent Application No.HEI3-11639

A pointed head (6) is provided and a front end thereof is triangle-shaped, having no thickness. Therefore, following problems are noticed.

(a) Upon erasing, a front end portion 6*a* of the head 6 is pressed on a paper surface not at right angle but in a condition that the front end portion 6*a* is inclined relative to the direction of advancement of the head 6. Therefore, if a large pressing force is applied, the front end of the head 6 is warped to an opposite side so that the head 6 comes into a contact with the paper through a curved surface thereof having a slight width in the direction of the advancement.

Thus, corrective coating material is pressed over a wide range of the paper at the same time, so that it becomes difficult to affix the corrective coating material accurately to a desired position. Further, there may occur a case in which the surface of the affixed corrective coating material is shaved more than required, thereby deteriorating the surface condition.

(b) Because the front end portion 6*a* of the head 6 is pointed and thin, when the corrective tape is folded along the front end of the head 6 and wound back, there is a fear that this folding portion becomes a sharp angle so that the corrective tape itself is cut down.

Further, the front end portion 6*a* of the head 6 is likely to chip or break down.

(c) If the front end portion 6*a* is warped as mentioned above when the head 6 is pressed, it is difficult to see the termination of the corrective coating material on the paper precisely and it is also difficult to separate the corrective coating material accurately at this termination. Therefore, to cut off the corrective coating film affixed to the paper surface in a good manner and effectively, it is necessary to raise the printer head substantially at right angle relative to the transferring face after the transfer is completed and then lift it up. However, such a procedure is troublesome and ineffective.

(2) Examined Published Japanese Patent Application NO.HEI3-66159

Although the front end portion 22 of a transfer head 20 has a substantially inverse triangle section, a front end face 22*a* thereof is not pointed, but an inverse-V shaped groove 25 facing in the advancement direction is provided.

Therefore, the corrective tape 11 is pressed on a paper through two protrusions in front of and behind the inverse-V shaped groove 25 on the transfer head 20, so that a pressing force for the corrective coating material onto the paper is weak in the middle of the groove 25.

Further, forming the V-shaped groove 25 on a narrow front end portion of the transfer head 20 takes time and labor.

(3) Examined Published Japanese Patent Application No.HEI3-33125

Although a tape is reversed along a press-fit edge 14' which is a front end of a rubbing lined piece 14, because this press-fit edge 14' has roundness, following problems exist.

(a) Because it is difficult to see clearly around the press-fit edge, a transfer start position cannot be determined easily.

(b) A film 5*a* on a support sheet 5 or a coating film cannot be separated from the press-fit edge 14' accurately at a desired position or this is very difficult.

(4) Unexamined Published Japanese Patent Application No.SHO50-152834

A tape (a) in which an adhesive agent layer (b) is formed on an entire surface thereof is brought into a contact with a position desired to be masked by a roller 8, so that the adhesive agent is peeled and made to stick to a paper. Because the tape (a) is pressed onto the paper surface by the round roller 8, it is almost impossible to make the tape into contact with a limited position on the paper accurately.

Further, the roller 8 has only a function for pressing the tape (a) but cannot cut off the adhesive agent layer (b).

(5) U.S. Pat. No. 3,274,038

This apparatus comprises only a feeding reel in which adhesive agent 15 is provided on the surface of a liner 14.

A winding tape 10 is fed out from a core 11. A tape contacting portion 20 for bringing the tape 10 into contact with a paper surface 30 is laterally cylindrical.

Therefore, like the reference document 3, it is difficult or impossible to apply adhesive agent 15 selectively and accurately to a desired location.

Additionally, an excessive portion of the adhesive agent 15 cannot be cut off accurately and sharply at a desired position of the liner 14.

(6) U.S. Pat. No. 3,505,153

Because a front end portion 52 of a nose is hidden by an adapter plate 20 and a front end portion of the adapter plate 20 has a pretty width, a wide range around the front end thereof is hidden, so that it is difficult or impossible to affix a tape (T) accurately to only a desired location. Thus, sometimes, a letter not desired to be erased is erased or a letter desired to be erased is left unerased.

Further, a top portion of the front end portion 52 is flat and is not protruded from side plates 14. In this apparatus, the tape is entirely only pressed to a location desired to be erased and its tape cutting performance is low.

(7) EP No.0551522A1

A tape 19 is guided and a tip of a pointed portion 18 for folding back the tape is a sharp, triangle shape.

Therefore, this invention has a similar problem as that described in the aforementioned reference document 1.

SUMMARY OF THE INVENTION

The present invention has been achieved to solve the above problems and therefore, it is an object of the invention to provide a coating film transfer apparatus wherein a corrective tape or other coating film applied tape is firmly pressed to a desired location on a paper or the like accurately, so as to affix a transfer coating film to that position and after that, an unnecessary portion of the transfer coating film is separated from a base tape accurately and easily.

To achieve the above object, according to a first aspect of the present invention, there is provided a coating film transfer apparatus comprising a supply reel and a winding reel for a coating film provided tape in which a transfer coating film is affixed to a surface of a base tape thereof, both the reels being mounted in a case, wherein a part of the coating film provided tape is reversed along a bottom end of a pressing lever projecting out from a cutout hole provided in the case from forward to backward and wound up by the winding reel, and by pressing the bottom end of the pressing lever onto a desired location on a paper surface, the transfer coating film on the surface of the coating film provided tape is affixed to the desired location of the paper surface and then an excessive portion of the transfer coating film is cut off, a bottom end face of the pressing lever being formed in a flat face having a width in the back and forth direction, a front edge of the bottom end face being formed in a sharp linear angle edge.

According to a second aspect of the invention, there is provided a coating film transfer apparatus according to the aforementioned first aspect wherein said pressing lever narrows gradually as it goes downward to an end portion thereof.

According to a third aspect of the invention, there is provided a coating film transfer apparatus according to the aforementioned first aspect wherein a front face and a rear face of the pressing lever are formed so as to be parallel to each other.

According to a fourth aspect of the invention, there is provided a coating film transfer apparatus according to the first-third aspect wherein the rear edge of the bottom end face of the pressing lever is also formed in a sharp linear angle edge.

According to a fifth aspect of the invention, there is provided a coating film transfer apparatus according to the aforementioned first aspect wherein a vertically expanding portion is provided on a rear face of the pressing lever to strengthen stiffness of a lower portion thereof, the bottom end face of the pressing lever is formed in a flat surface having a width in the back and forth direction and the front edge is formed in a sharp linear angle edge.

According to a sixth aspect of the invention, there is provided a coating film transfer apparatus according to the aforementioned fifth aspect wherein a lateral section of the expanding portion is semi-circular directing backward.

According to a seventh aspect of the invention, there is provided a coating film transfer apparatus according to the fifth aspect wherein the lateral section of the expanding portion is of a triangle shape projecting backward.

According to an eighth aspect of the invention, there is provided a coating film transfer apparatus according to the aforementioned fifth aspect wherein the lateral section is a square block projecting backward.

DESCRIPTION OF THE PREFERRED EMBODIMENTS

The first and second aspects of the invention mentioned above will be described regarding an embodiment of a coating film transfer apparatus capable of masking writing errors on a paper using a corrective tape, in which a corrective coating film is attached to a base tape thereof via a releasing layer, with reference to FIGS. 1–6.

Figure 1:
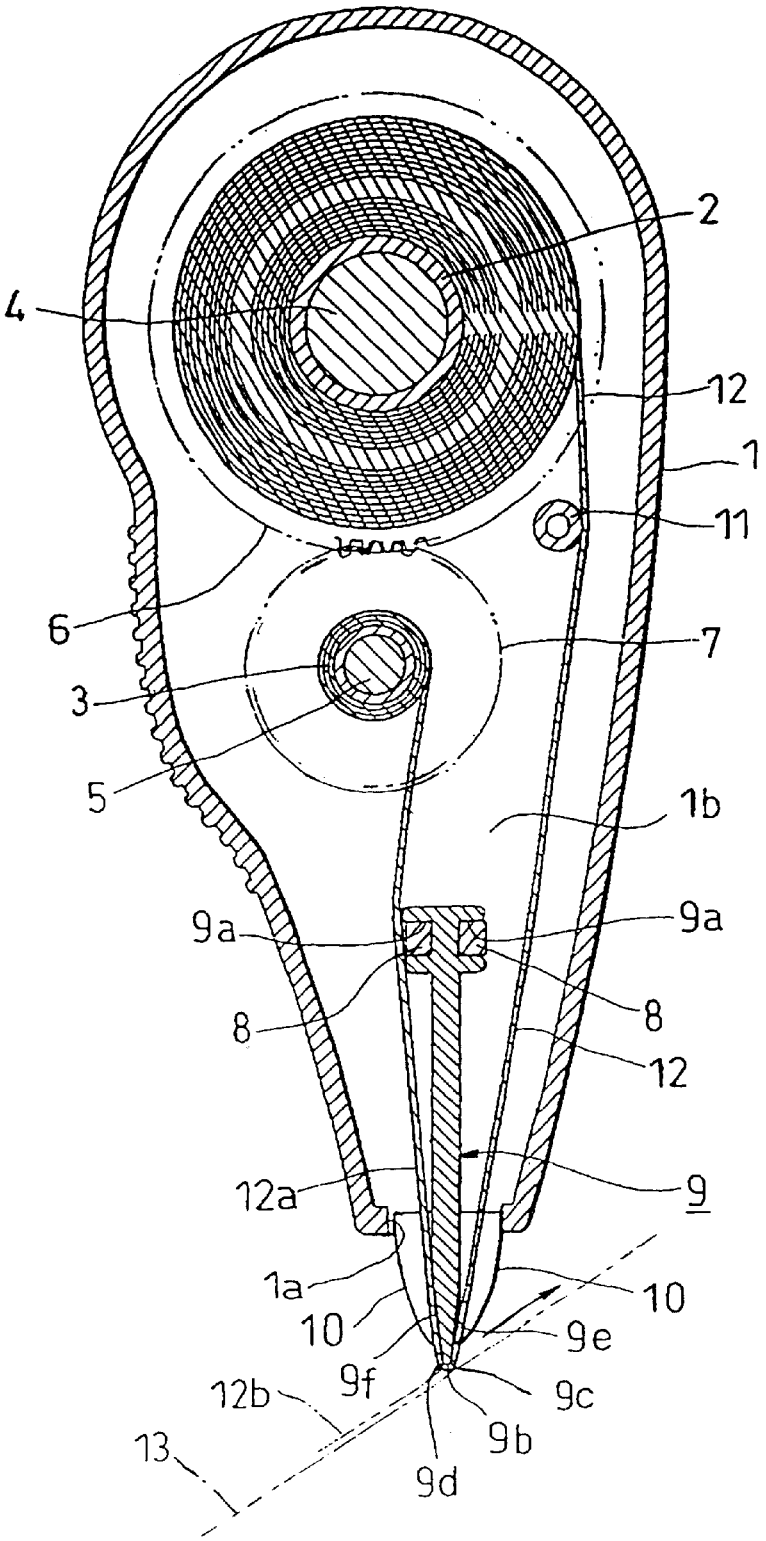
FIG. 1 is a side view showing an interior compartment of a case of a coating film transfer apparatus for masking a writing error according to an embodiment of the present invention, with its lid plate removed.

In FIG. 1, it means that the right is front and the left is back. As shown in FIG. 1, a flat box type case 1, which narrows toward an end thereof and has a cutout hole 1*a* at a bottom end thereof with a side thereof open, contains a supply reel 2 provided at a upper side of the same case and a winding reel 3 provided below the supply reel 2, both the reels being supported by supporting shafts 4, 5.

A large diameter spur gear 6 integral with the supply reel 2 meshes with a small diameter spur gear 7 integral with the winding reel 3. A pair of supporting protrusions 8, 8 located in back and forth direction are formed with an appropriate interval on a bottom wall 1*b* of the case 1 over the cutout hole 1*a*.

Figure 2:
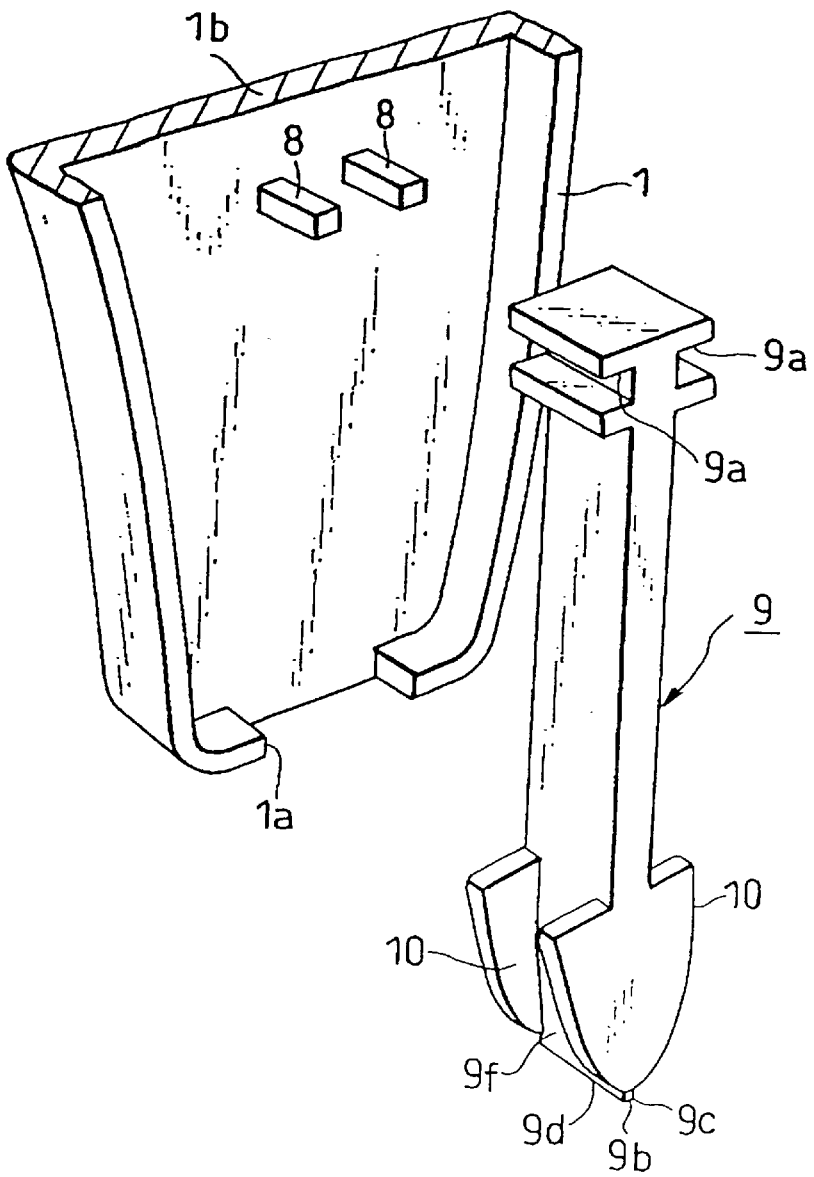
FIG. 2 is a disassembly perspective view showing a lower portion of a case and a pressing lever of FIG. 1 in enlargement.

As evident from FIG. 2, inward concave portions 9*a*, 9*a* located at an top end of a long pressing lever 9 the bottom end of which projects downward through the opening 1*a* of the case 1 such that they are located in the back and forth direction are fit to the supporting protrusions 8, 8 appropriately.

As a result, the pressing lever 9 is held in the case 1 so that it does not move in the back and forth direction or in up and down direction.

Figure 3:
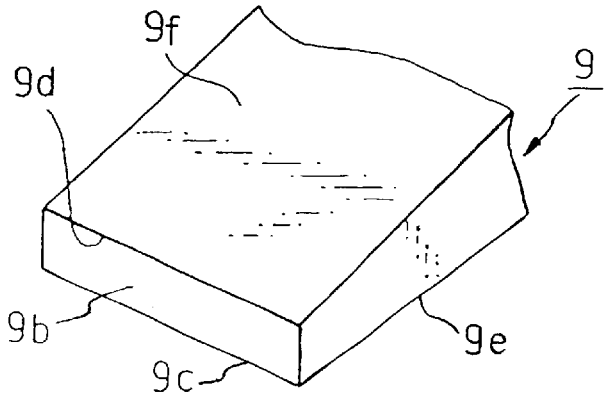
FIG. 3 is an enlarged perspective view showing a bottom end portion of the pressing lever as viewed from back.

As shown in FIG. 3, in one embodiment a bottom end portion of the pressing lever 9 gradually narrows in its width in the back and forth direction toward the bottom end and a bottom end face 9*b* is a flat face having a width in the back and forth direction. Further, usually, the front edge 9*c* and rear edge 9*d* of the bottom end face 9*b* are linear edges each having an angle slightly larger than a right angle. However, depending on the case, that angle may be slightly smaller than a right angle.

In one embodiment, the front face 9*e* and rear face 9*f* of the bottom end portion of the pressing lever 9 are parallel to each other (see FIG. 2). Or the pressing lever 9 may be a flat plate having a predetermined width in the back and forth direction.

On left and right side faces of the bottom end portion of the pressing lever 9 are formed contacting pieces 10, 10 for keeping the pressing lever 9 from moving in the back and forth of the cutout hole 1*a* of the case 1 such that they are integral with the pressing lever 9.

A small diameter cylinder 11 is provided in front of and below the supply reel 2, on the bottom wall of the case 1.

On the supply reel 2 is wound a corrective tape 12 in which a corrective coating film 12*b* is attached as a transfer coating film to a surface of a base tape 12*a*. This corrective tape 12 passes along a front side of the cylinder 11 and a bottom end front edge 9*c* of the pressing lever 9 and rises along a rear face 9*f* of the pressing lever 9 up to the winding reel 3.

Figure 4:
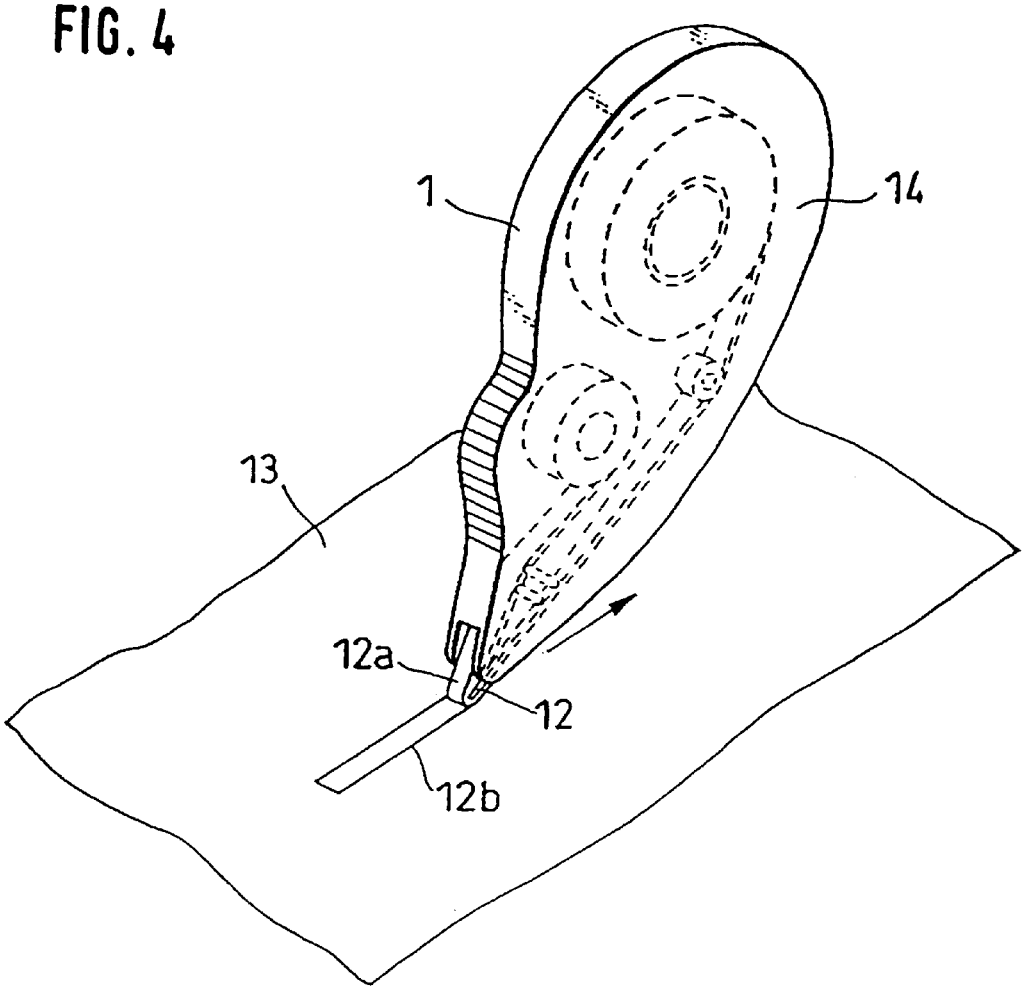
FIG. 4 is a perspective view showing a use condition of a coating film transfer apparatus of FIGS. 1–3.

An side opening of the case 1 is closed by attaching a lid plate 14 appropriately as shown in FIG. 4.

As shown in FIG. 4, the coating film transfer apparatus having the above described structure is placed on a paper 13 such that the bottom end face 9*b* of the pressing lever 9, around which the corrective tape 12 is wound is in contact with a place having a writing error or the like desired to be masked, and usually, the top portion of the case 1 gripped by the hand is moved in a condition that it is slightly inclined forward. As a result, a desired corrective work by the coating film is done.

Figure 5:
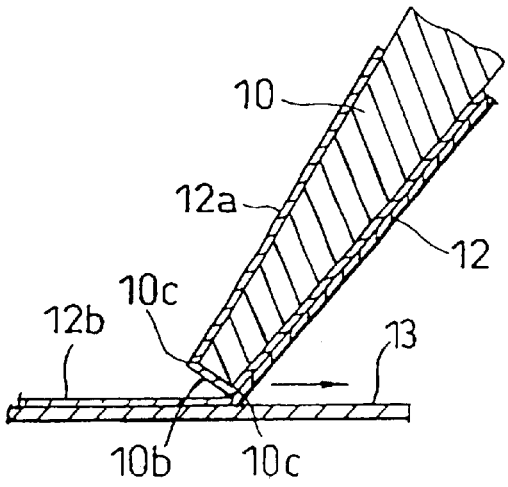
FIG. 5 is an enlarged side view showing a bottom end portion of the pressing lever of FIG. 4 and a corrective tape running along the same bottom end portion.

That is, if the case 1 is moved forward with its top portion inclined forward in the above described manner, the corrective tape 12 is pressed down to the paper by the front edge 9*c* of the bottom end face 9*b* of the pressing lever 9. Consequently, the corrective coating film 12*b* attached to the surface of the corrective tape 12 is transferred to a place having a writing error desired to be erased on the paper 13 and that place is masked as shown in FIG. 5.

If the masking procedure is finished, the front edge 9*c* of the bottom end face 9*b* of the pressing lever 9 is mildly pressed to the paper 13 and the pressing lever 9 is raised with the case 1.

As a result, a front edge or terminal end of the corrective coating film 12*b* on the paper 13 is cut beautifully and precisely.

Figure 6:
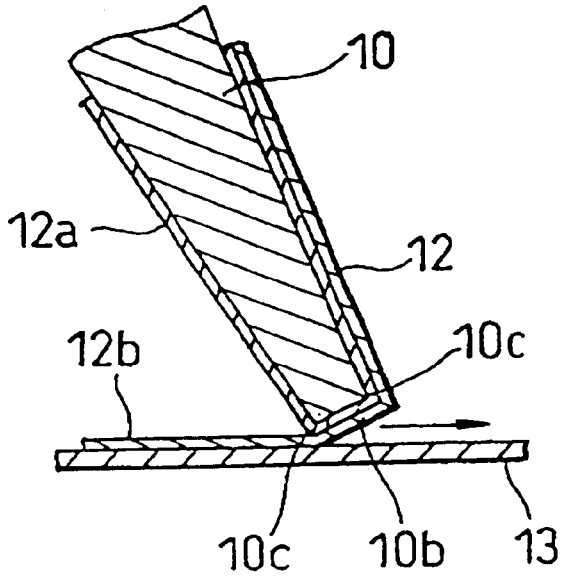
FIG. 6 is the same figure as FIG. 5 in case the inclination direction of the pressing lever is opposite.

Depending on a place desired to be masked or a skillful hand of user, it is also possible to move the case 1 with the pressing lever 9 inclined backward as shown in FIG. 6. Although in this case, the rear edge 9*d* of the bottom end face 9*b* of the pressing lever 9 presses the corrective tape 12, a step for the corrective coating film 12*b* to adhere to the paper 13 is the same as described above.

When the front edge or terminal end of the corrective coating film 12*b* adhering to the paper 13 is cut by the rear edge 9*d* of the bottom end face 9*b* of the pressing lever 9 after use and then the pressing lever 9 is raised, also the corrective tape 12 on which the corrective coating film 12*b* is applied as an external face thereof is left on the bottom end face 9*b* having a width in the back and forth direction of the pressing lever 9.

Therefore, if this coating film transfer apparatus is lifted up with this condition and brought onto a minute area required to be masked at a different place on the paper, by simply pressing the bottom end face 9*b* of the pressing lever 9 on that position, the coating film can be transferred precisely to only that minute area.

According to this embodiment, upon use of this apparatus, a sharp edge stretching laterally on the front edge 9*c* of the bottom end face 9*b* of the pressing lever 9 presses the corrective tape 12 strongly on the paper 13 as shown in FIG. 5, so that the corrective coating film 12*b* is transferred to the paper 13, the base tape 12*a* is moved along the bottom end face 9*b* of the pressing lever 9 having a width in the back and forth direction and then raised along the rear face 9*f* of the pressing lever 9.

Thus, according to this embodiment, following operations and effects which cannot be expected in a conventional apparatus of this kind are ensured.

(1) The sharp edge which is the front edge 9*c* of the bottom endface 9*b* of the pressing lever 9 presses the corrective tape 12 onto the paper 13 linearly along the left and right direction and the bottom end face 9*b* of the pressing lever 9 has a width in the back and forth direction. Therefore, the front end of the pressing lever 9 is never deformed when pressed unlike the arts described in Reference Documents 1 and 7. A pressing load is concentrated effectively on this pressed portion so that the corrective coating film 12*b* on the surface of the corrective tape 12 is firmly affixed to the paper 13 securely, and therefore, the corrective coating film 12*b* never automatically peels from the paper 13.

(2) Because the front edge 9*c* or rear edge 9*d* of the bottom end face 9*b* of the pressing lever 9 is floated from the paper 13, it is easy to see a position to be masked on the paper 13 and it is possible to cut off a beginning point and terminal point of the corrective coating film 12*b* to be transferred to a desired point on the paper 13 thereby finishing beautiful correction. The inventions mentioned in the reference documents (3)–(6) do not provide such an excellent view.

(3) If after the corrective coating film 12*b* is affixed to the paper surface 13, the pressing lever 9 is raised at right angle relative to the paper surface 13 so that the bottom end face 9*b* is made into a firm contact with the paper surface 13 through the corrective tape 12, the corrective coating film 12*b* already affixed to the paper surface 13 is pressed down to the paper surface 13 again over an entire range of the bottom end face 9*b* of the pressing lever 9 and the affixing condition is further equalized and strengthened. Such an operation and effect cannot be obtained in the reference document 2.

(4) When this coating film transfer apparatus is moved on the paper surface 13 in a condition that it is inclined forward, the corrective tape 12 comes into contact with the paper surface 13 linearly through a minute area provided by a sharp edge of the front edge 9*c* or rear edge 9*d* of the bottom end face 9*b* of the pressing lever 9. Thus, the corrective tape 12 can be made into a contact with a position desired to be masked easily and accurately.

(5) The coating film transfer apparatus can be used by moving it forward with the pressing lever 9 facing to an opposite direction, namely, the top portion inclined backward. After lifting up the coating film transfer apparatus off the paper surface, it is possible to mask only a small area on the paper with the corrective coating film 12*b* on an outside surface of the corrective tape 12 contacting the bottom end face 9*b* of the pressing lever 9.

Because in the present invention, the front edge 9*c* of the bottom end face 9*b* of the pressing lever 9 is pressed on the paper surface strongly, it is preferred to strengthen the stiffness of the bottom part of the pressing lever 9 in the back and forth direction.

Figure 7:
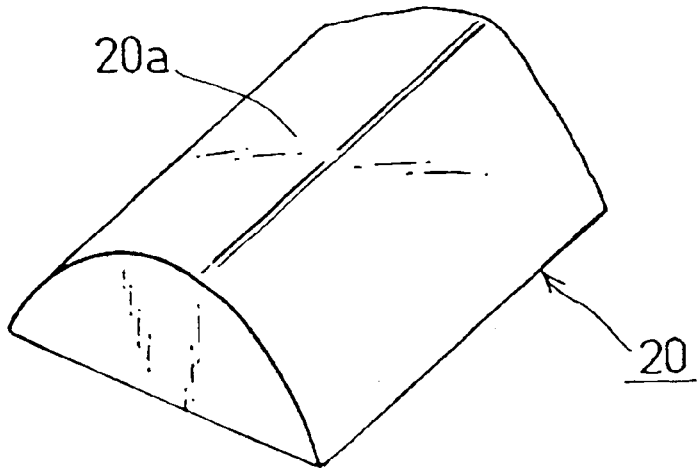
FIG. 7 is an enlarged sectional view showing another example of the bottom end portion of the pressing lever.
Figure 8:
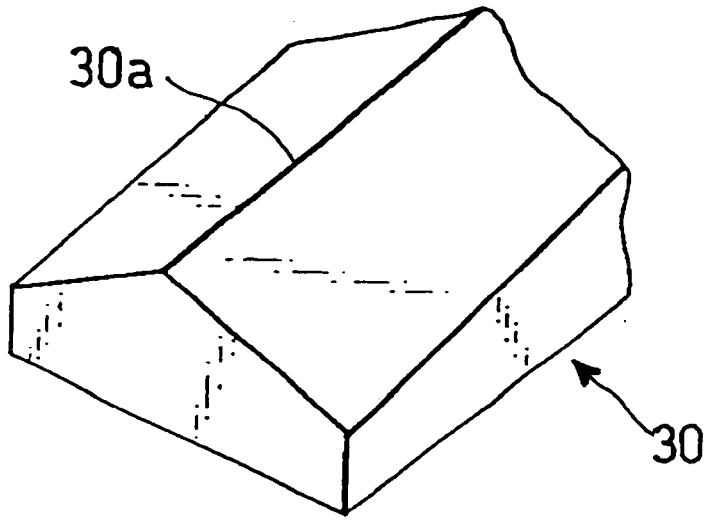
FIG. 8 is an enlarged sectional view showing still another example of the bottom end face of the pressing lever.
Figure 9:
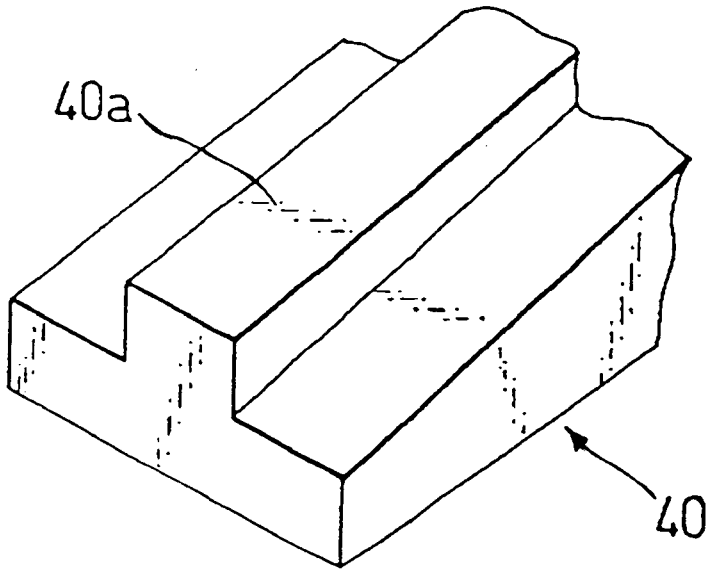
FIG. 9 is an enlarged sectional view showing a further example of the bottom end face of the pressing lever.

To strengthen the stiffness of the pressing lever 9 in the back and forth direction, a vertically-expanding portion is provided on a rear face of the bottom part of the pressing lever 9. FIGS. 7–9 show these examples. In FIG. 7, a semicircular protrusion 20*a* directing backward is provided on the rear face of the pressing lever 20. In FIG. 8, a triangular protrusion 30*a* projecting backward is provided on the rear face of the pressing lever 30. In FIG. 9, a square block protrusion 40*a* projecting backward is provided on the rear face of the pressing lever 40.

Therefore, this invention provides following effects.

The invention described in all aspects of the invention provides a following effect.

The transfer coating film can be affixed strongly to a desired position on a paper accurately and easily, and an excessive portion of the corrective coating film can be cut off at a desired position beautifully.

According to the invention described in a second aspect of the invention, it is made easy to see a position of the paper on which a coating film is to be transferred.

According to the invention described in a third aspect of the invention, this coating film transfer apparatus can be used in any direction of forward and backward.

According to the invention described in fourth to eighth aspects of the invention, the coating film tape can be pressed strongly by the pressing lever so that the corrective coating film can be affixed strongly to the paper surface.

What is claimed is:

1. A coating film transfer apparatus comprising a supply reel and a winding reel for a coating film provided tape in which a transfer coating film is affixed to a surface of a base tape thereof, both the reels being mounted in a case, wherein a part of the coating film provided tape is slid about a bottom end face of a pressing lever projecting out from a cutout hole provided in the case to thereby have its direction of travel reversed and to be slid across said bottom end face from a front to rear face of said pressing lever and then be wound up by the winding reel, whereby by pressing the bottom end face of the pressing lever with the part of the coating film provided tape thereon onto a desired location on a paper surface, the transfer coating film on the surface of the coating film provided tape is affixed to the desired location of the paper surface and then an excessive portion of the transfer coating film is cut off, wherein:

the bottom end face of said pressing lever is formed as a flat face having a width in back and forth direction, between said front and rear faces of said pressing lever, a front edge of the bottom end face at said front face is formed as a sharp linear angle edge, and a vertically expanding portion is provided on a rear face of said pressing lever to strengthen stiffness of a lower portion of said pressing lever so that in a lateral section of said pressing lever said vertically expanding portion has a square block shape projecting rearwardly, away from said front face.

2. The coating film transfer apparatus as claimed in claim 1 wherein said pressing lever narrows gradually as it goes downward to said end portion thereof.

3. The coating film transfer apparatus as claimed in claim 1 wherein the front face and a rear face of said pressing lever are formed so as to be parallel to each other.

4. The coating film transfer apparatus as claimed in claim 1 wherein a rear edge of the bottom end face at said rear face is also. formed as a sharp linear angle edge.

5. A coating film transfer apparatus comprising a supply reel and a winding reel for a coating film provided tape in which a transfer coating film is affixed to a surface of a base tape thereof, both the reels being mounted in a case, wherein a part of the coating film provided tape is slid about a bottom end face of a pressing lever projecting out from a cutout hole provided in the case to thereby have its direction of travel reversed and to be slid across said bottom end face from a front to rear face of said pressing lever and then be wound up by the winding reel, whereby by pressing the bottom end face of the pressing lever with the part of the coating film provided tape thereon onto a desired location on a paper surface, the transfer coating film on the surface of the coating film provided tape is affixed to the desired location of the paper surface and then an excessive portion of the transfer coating film is cut off, wherein:

the bottom end face of said pressing lever is formed as a flat face having a width in back and forth direction, between said front and rear faces of said pressing lever, a front edge of the bottom end face at said front face is formed as a sharp linear angle edge, and a rear edge of the bottom end face at said rear face is also formed as a sharp linear angle edge.

6. The coating film transfer apparatus as claimed in claim 5 wherein said pressing lever-narrows gradually as it goes downward to said end portion thereof.

7. The coating film transfer apparatus as claimed in claim 5 wherein the front face and a rear face of said pressing lever are formed so as to be parallel to each other.

8. The coating film transfer apparatus as claimed in claim 5 wherein a vertically expanding portion is provided on a rear face of said pressing lever to strengthen stiffness of a lower portion thereof.

9. The coating film transfer apparatus as claimed in claim 8 wherein, in a lateral section of said pressing lever, said vertically expanding portion has a semi-circular shape directed rearwardly, away from said front face.

10. The coating film transfer apparatus as claimed in claim 8 wherein, in a lateral section of said pressing lever, said vertically expanding portion has a triangular shape projecting rearwardly, away from said front face.

11. The coating film transfer apparatus as claimed in claim 8 wherein, in a lateral section of said pressing lever, said vertically expanding portion has a square block shape projecting rearwardly, away from said front face.

* * * * *